US009301063B2

(12) United States Patent
Schmidt et al.

(10) Patent No.: US 9,301,063 B2
(45) Date of Patent: Mar. 29, 2016

(54) HEARING INSTRUMENT ADAPTED TO HOLD AN EXCHANGEABLE RECEIVER INTO THE HOUSING AND A METHOD FOR MAKING THE HEARING INSTRUMENT

(75) Inventors: Benjamin Schmidt, Nuremberg (DE); Frank Rosenberger, Erlangen (DE); Konrad Sickel, Erlangen (DE); Vojtech Bubnik, Prague (CZ)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/350,207

(22) PCT Filed: Mar. 2, 2012

(86) PCT No.: PCT/EP2012/053629

§ 371 (c)(1),
(2), (4) Date: Apr. 7, 2014

(87) PCT Pub. No.: WO2013/050183

PCT Pub. Date: Apr. 11, 2013

(65) Prior Publication Data

US 2014/0286512 A1 Sep. 25, 2014

Related U.S. Application Data

(60) Provisional application No. 61/543,447, filed on Oct. 5, 2011.

(51) Int. Cl.

| | |
|---|---|
| ***H04R 25/00*** | (2006.01) |
| ***H04R 1/10*** | (2006.01) |
| ***H04R 31/00*** | (2006.01) |

(52) U.S. Cl.

CPC ..... *H04R 25/608* (2013.01); *H04R 1/1075* (2013.01); *H04R 25/604* (2013.01); *H04R 31/006* (2013.01); *H04R 25/652* (2013.01); *Y10T 29/49572* (2015.01)

(58) Field of Classification Search

CPC .. H04R 25/604; H04R 25/608; H04R 25/652; H04R 1/1075

See application file for complete search history.

(56) References Cited

U.S. PATENT DOCUMENTS

| | | | | |
|---|---|---|---|---|
| 5,881,159 | A * | 3/1999 | Aceti | A61B 5/6817 381/322 |
| 7,822,218 | B2 | 10/2010 | Van Halteren | |
| 8,340,335 | B1 * | 12/2012 | Shennib | 381/328 |
| 2001/0043708 | A1 * | 11/2001 | Brimhall | H04R 25/456 381/328 |
| 2005/0190940 | A1 | 9/2005 | Ach-Kowalewski et al. | |
| 2006/0045297 | A1 * | 3/2006 | Haussmann | 381/322 |
| 2006/0153418 | A1 * | 7/2006 | Van Halteren | 381/396 |
| 2010/0220884 | A1 * | 9/2010 | Aquilina | H04R 25/608 381/328 |
| 2011/0013797 | A1 | 1/2011 | Cheng et al. | |
| 2011/0103610 | A1 * | 5/2011 | Harsch | H04R 1/1016 381/74 |

FOREIGN PATENT DOCUMENTS

| | | | |
|---|---|---|---|
| EP | 1684544 | A2 | 7/2006 |

* cited by examiner

*Primary Examiner* — Tuan D Nguyen

(74) *Attorney, Agent, or Firm* — Laurence A. Greenberg; Werner H. Stemer; Ralph E. Locher

(57) ABSTRACT

A hearing instrument includes a housing and an exchangeable receiver. The hearing instrument further includes an opening in the housing for receiving the exchangeable receiver therein, and a coupler for actuating/de-actuating a physical coupling between the housing and the exchangeable receiver and for enabling the housing to hold the receiver.

16 Claims, 3 Drawing Sheets

HEARING INSTRUMENT ADAPTED TO HOLD AN EXCHANGEABLE RECEIVER INTO THE HOUSING AND A METHOD FOR MAKING THE HEARING INSTRUMENT

BACKGROUND OF THE INVENTION

Field of the Invention

The invention relates to a hearing instrument which can hold an exchangeable receiver into an housing for a hearing instrument.

In a hearing instrument, a receiver works an interface for carrying a sound into the ear. The hearing instrument can be a music player, a hearing air or a telephonic device. As every instrument of a hearing instrument has a life time and it needs to be replaced after, in same way, the receiver also needs to be replaces when it starts malfunctioning or gets destroyed.

To replace the receiver, in some instruments where a shell is permanently fixed over the receiver, the shell needs to be broken to replace the receiver. In such cases, the shell is also needs to be replaces. In few other instruments where a face plate is provided which holds assembly of battery door, battery contacts and other elements of the hearing instrument, specifically state of art hearing aids, the face plate is removed to replace the receiver. This disturbs the assembly of the elements of the hearing instrument placed onto the faceplate. Thus in both the cases removal of the receiver is uneasy for an user of the hearing instrument, rather it requires an expert of hearing instrument.

BRIEF SUMMARY OF THE INVENTON

It is an object of the invention to simplify replacement of a receiver in a hearing instrument.

The object of the invention is achieved by a hearing instrument and a method to make a hearing instrument as follows:

According to an embodiment of the hearing instrument, the hearing instrument includes an exchangeable receiver and a housing which with an opening for receiving the exchangeable receiver within. The hearing instrument further includes a coupler adapted to actuate/de-actuate a physical coupling between the housing and the exchangeable receiver, and further adapted to enable the housing to hold the receiver. The coupler is a magnetic arrangement comprising a first magnet at housing and a second magnet at exchangeable receiver. This makes de-actuation/actuation user friendly.

According to another embodiment of the hearing instrument, the coupler comprising a protrusion at a surface of the exchangeable receiver and an interlocking structure coupled to a surface of the housing adapted to lock in the protrusion while actuating the physical coupling and to lock out the protrusion while de-actuating the physical coupling. This provides a simple mechanical structure for the coupler.

According to yet another embodiment of the hearing instrument, the interlocking structure is an assembly of a pinhole on the surface of the housing and a locking pin adapted to be locked into the pinhole for actuating and to be locked out of the pinhole for de-actuating the physical coupling between the exchangeable receiver and the housing. This provides a simple way to provide the actuating and de-actuating of the physical coupling by the assembly of pinhole and the pin of the interlocking structure.

According to an exemplary embodiment of the hearing instrument, wherein the protrusion is made of a compressible material for allowing the protrusion to be compressed to slide into the housing while actuating or slide out of the housing while de-actuating the physical coupling. Such a protrusion helps easy movement of the receiver while actuating and deactuating the physical coupling.

According to one embodiment of the hearing instrument, the hearing instrument includes a sealing adapted to be placed into the opening of the housing between the exchangeable receiver and the housing for sealing a remaining portion of the opening, wherein the remaining portion of the opening is defined as an area of the opening left after placing the exchangeable receiver into the opening. Such a sealing protects the coupler to be dysfunctional by external environment like dust, moisture, swear of the user, etc.

According to another embodiment of the hearing instrument, wherein a part of the sealing facing the housing has a wedge shaped geometry. Such geometry of sealing helps to tightly fix the sealing between the receiver and the housing into the remaining portion of the opening.

According to an exemplary embodiment of the hearing instrument, the hearing instrument includes a receiver cup adapted to receive the receiver and the exchangeable receiver is coupled to the housing via the receiver cup. By using the coupler, the receiver need not be modified for providing the physical coupling between the receiver and the housing; rather the receiver cup is used for providing the physical coupling between the receiver and the housing.

BRIEF DESCRIPTION OF THE SEVERAL VIEWS OF THE DRAWING

The above-mentioned and other features of the invention will now be addressed with reference to the drawings of a preferred embodiment of the present hearing instrument. The illustrated embodiment of the hearing instrument is intended to illustrate, but not limit the invention. The drawings contain the following figures, in which like numbers refers to like parts, throughout the description and drawings.

DESCRIPTION OF THE INVENTION

FIG. 1A, FIG. 1B, FIG. 1C and FIG. 1D illustrates an embodiment of a hearing instrument, so they will be discussed in combination and while describing each of the they reference would be made to each other.

Figure 1A:
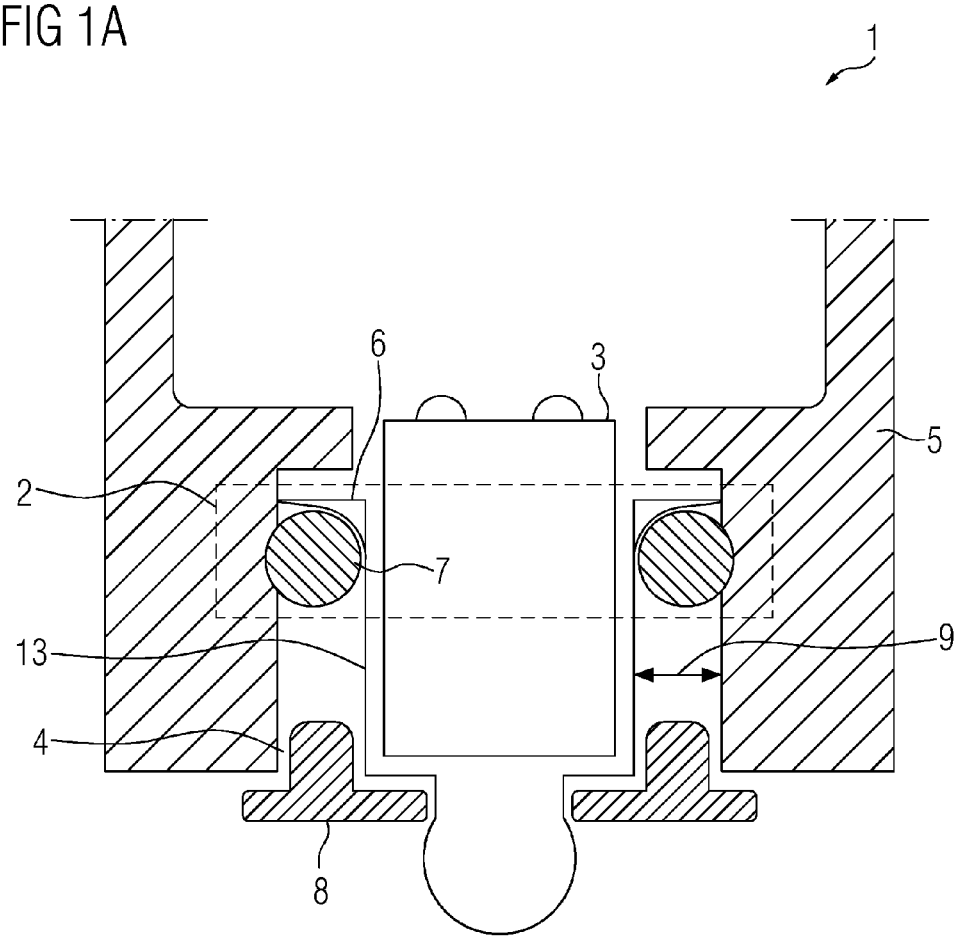
FIG. 1A illustrates a front end sectional view of a hearing instrument.

FIG. 1A discloses a hearing instrument 1 having a housing 5 to receive a receiver 3 through an opening 4 and the housing 5 further holds the receiver 3 via a receiver cup 13 using a coupler 2 which provides a physical coupling between the housing 5 and the receiver 3 on being actuated. The coupler 2 un-holds the receiver 3 when the physical coupling between the housing 5 and the receiver 3 is de-actuated.

The housing 5 is an exterior portion of the hearing instrument 1 which holds the receiver 3 and other elements like battery, battery cover, microphone, etc. The purpose of the housing 5 holding the receiver 3 is to ensure mechanical stability of the receiver 3 by providing enough material, i.e., wall thickness around the receiver 3 to hold it in place during use. The housing 5 may be further attached to a customized shell which is made according to an user's ear.

The receiver 3 is an interface between the hearing instrument 1 and the user's ear to transfer a sound, whether a conversation in case of hearing aid or music in case of headphone connected to music player or any sound from any hearing instrument 1, from the hearing instrument 1 to the user's ear.

The coupler 2 has a protrusion 6 at a surface of the receiver cup 13 and an interlocking structure 7 provided onto a surface of the housing 5. In an alternate embodiment, where the hearing instrument 1 doesn't use the receiver cup 13, the receiver 3 has the protrusion 6. The interlocking structure 7 locks in the protrusion 6 while actuating the physical coupling and locks out the protrusion 6 while de-actuating the physical coupling. In an alternate embodiment, the coupler 2 includes a magnetic arrangement of a first magnet at housing 5 and a second magnet at exchangeable receiver 3 or the receiver cup 13. Both the magnets have the nature to attract each other. Hence for actuating the physical coupling, the receiver 3 needs to brought into the vicinity of the housing 5 through the opening 4 and attractive force between magnets works. And for de-actuating the physical coupling, an external force needs to be applied to bring out the receiver 3 from the vicinity of the housing 5 via the opening 4. Alternatively, the magnets are electrically controlled magnets whose orientation can be changed by applying voltage. In such case, for actuating the physical coupling an attractive orientation is established between the magnets and for deactuating the physical coupling a repulsive orientation is established between the magnets. Yet alternatively, the coupler 2 can use a combination of magnetic arrangement and protrusion 6 based interlocking structure 7 arrangement.

The protrusion 6 is made of a compressible material like plastic, rubber or any compressible polymer, for allowing the protrusion 6 to be compressed to slide into the housing 5 while actuating or slide out of the housing 5 while deactuating the physical coupling.

Figure 1B:
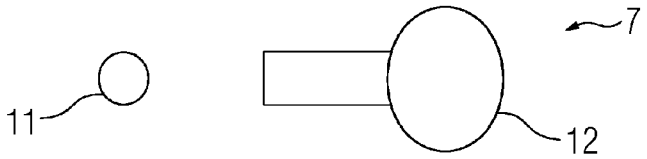
FIG. 1B illustrates an assembly of an interlocking structure as shown in FIG. 1A.

FIG. 1B illustrates the interlocking structure 7 of FIG. 1A. The interlocking structure 7 is an assembly of a pinhole 11 on the surface of the housing 5 and a locking pin 12 which locks into the pinhole 11 for actuating and locks out of the pinhole 11 for de-actuating the physical coupling between the exchangeable receiver 3 and the housing 5. The pinhole 11 and the locking pin (12) are provided with corresponding threads for locking or unlocking function for the assembly of interlocking structure 7. In an alternate embodiment, the pin 12 is secured to the pinhole 11 with some glue or shell material.

The pinhole 11 is drilled into the housing 5 with a geometry corresponding to the pin 12. The pin 12 and the pinhole 11 are both designed by using CAD related mechanism to provide accuracy to the geometry of the pin 12 and the pinhole 11. To provide strength to the pin 12 for avoiding wear and tear while removing the pin 12 for de-actuating the physical coupling, the pin 12 is made of strong material like metal or plastic.

Figure 1C:
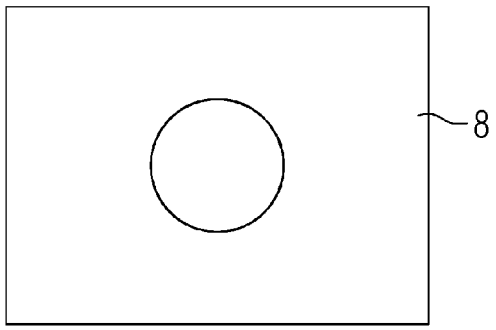
FIG. 1C illustrates top view of the sealing used in the hearing instrument of the FIG. 1A.

FIG. 1C illustrates an alternate sealing 8 included into the hearing instrument 1 of the FIG. 1A. The sealing 8 is a rubber ring placed into the opening 4 of the housing 5 between the receiver cup 13 holding the exchangeable receiver 3 and the housing 5 for sealing a remaining portion 9 of the opening 4, such that the remaining portion 9 of the opening 4 is defined as an area of the opening 4 left after placing the exchangeable receiver 3 into the opening 4. This helps to protect the coupler 2 and the receiver 3 against moisture and also avoids movements like vibrations of the receiver 3 and the receiver cup 13 holding the receiver 3. In an alternate embodiment, the hearing instrument 1 don't use sealing 8, rather the remaining portion 9 of the opening 4 remains opened. Yet alternately, the base of the receiver is large enough for not leaving any remaining portion 9 of the opening 4.

Figure 1D:
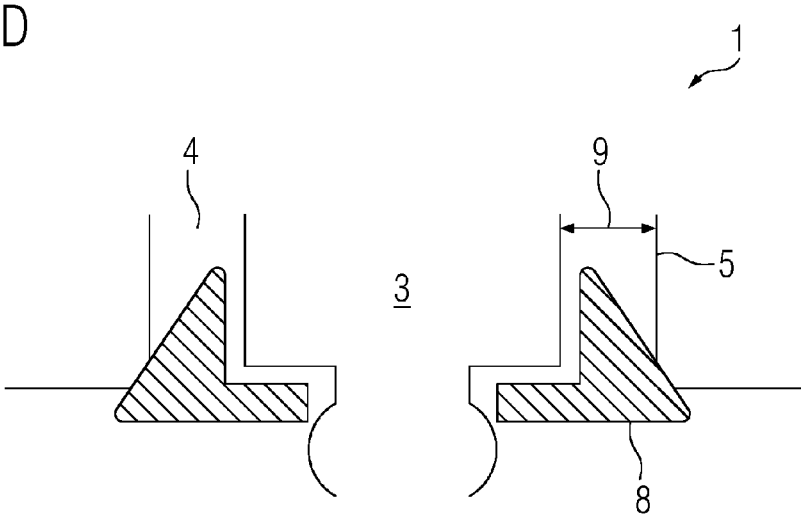
FIG. 1 D illustrates a front end sectional view of the hearing instrument according to FIG. 1A with wedge-shaped sealing.

FIG. 1D shows a front end sectional view of the hearing instrument 1 according to FIG. 1A which have an alternative to the sealing 8 of FIG. 1C. In this alternative, a part of the sealing 8 facing the housing 5 has wedge shaped geometry. The wedge provides stability to the sealing 8 to remain well in place during any kind of haphazard movement of the receiver 3 or the housing 5 holding the receiver 3. In an alternate embodiment, a part of the sealing facing the receiver 3 can also have wedge shaped geometry to still give more tight fitting to the sealing 8.

Figure 2:
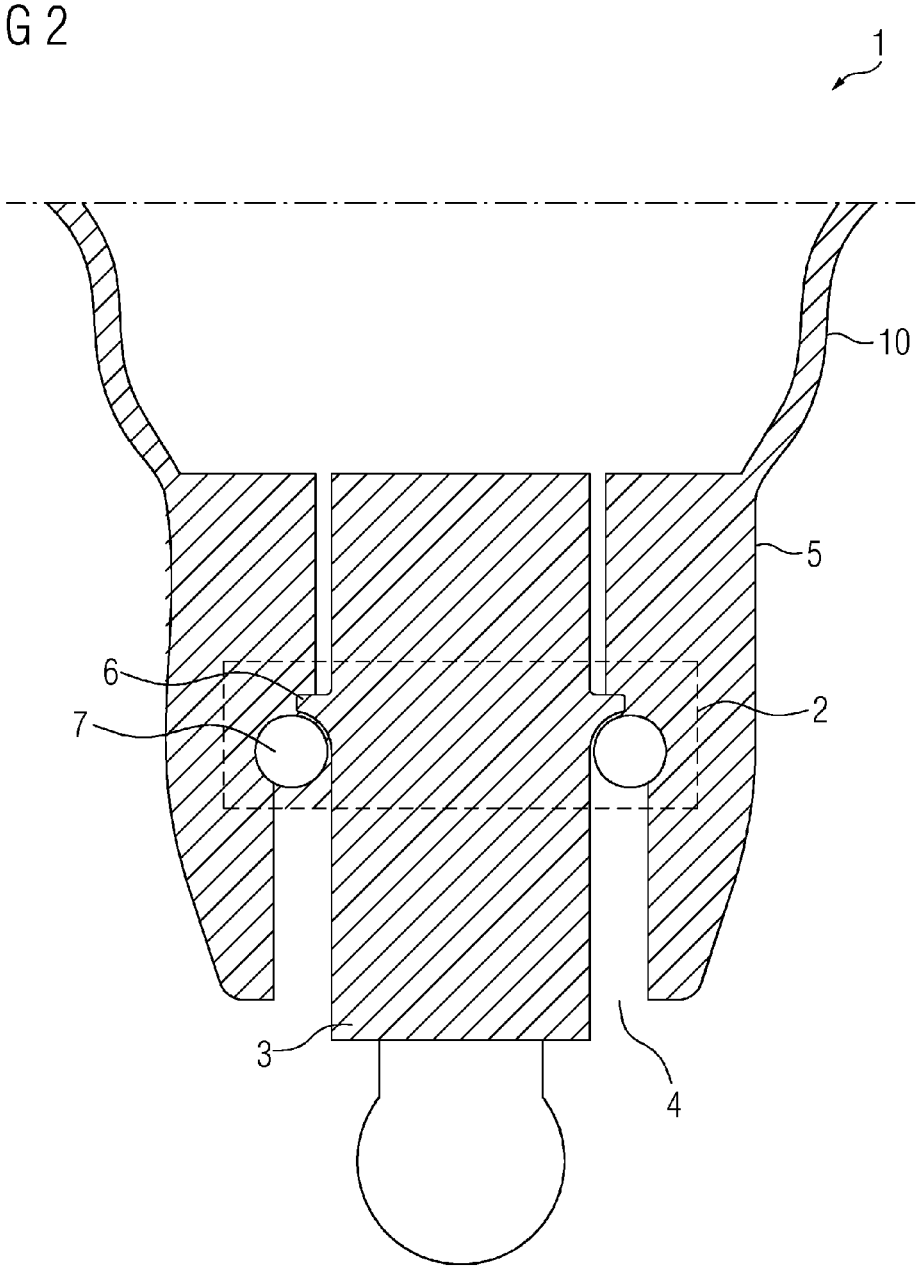
FIG. 2 illustrates a front end sectional view of an exemplary hearing instrument without a receiver cup.

FIG. 2 shows a front end sectional view of an exemplary hearing instrument 1 without a receiver cup. The hearing instrument 1 has two parts, one is housing 5 for holding a receiver 3, and another is a customized shell 10 smoothly attached to the housing 5. The customized shell 10 is made according to an user's ear. The transition between customized shell 10 and the housing 5 is smooth and can be automatically generated by CAD software. The customized shell 10 and the housing 5 are permanently connected. Alternatively the housing 5 and the customized shell 10 can be detachably connected. Permanent connection makes it very user specific and the customization and connection can be done at the manufacturer's side. Detachable connection has an advantage that the housing 5 and the customizable shell 10 can be separately manufactured by the manufacturer and can be connected by the user or the physician or the seller as per the user's requirement.

Further, the receiver 3 is placed inside the housing 5 through an opening 4 of the housing 5. For providing stability to the receiver 3, a coupler 2 is provided which has a interlocking structure 7 onto a surface of the housing 5 and a protrusion 6 made out on a side of the receiver 3. The protrusion 6 is made to closely fit the housing 5, so that while moving the receiver 3 in and out of the opening 4 of the housing 5, a user has to apply some force. To actuate a physical coupling of the receiver 3 and the housing 5, the receiver 3 is moved into the housing 5 by applying force and further locked using the interlocking structure 7. To deactuate the physical coupling of the receiver 3 and the housing 5, the receiver 3 is unlocked from the interlocking structure 7 and moved out of the housing 5 by applying force.

The interlocking structure 7 is an assembly of a pinhole made into the housing 5 and a pin. When the pin is placed into the pinhole and locked than the interlocking structure 7 actuates the physical coupling of the receiver 3 and the housing 5. And when the pin is removed out of the pinhole, the physical coupling between the receiver 3 and the housing 5 is deactuated.

The invention claimed is:

1. A hearing instrument, comprising:

a housing;

an exchangeable receiver configured to be received in an opening formed in and to be held by said housing;

a customized shell made according to a user's ear, said customized shell being smoothly attached to said housing and forming a smooth transition between said customized shell and said housing; and a coupler configured to actuate and de-actuate a physical coupling between said housing and said exchangeable receiver and to enable said housing to hold said exchangeable receiver.

2. The hearing instrument according to claim 1, wherein said coupler is a magnetic configuration including a first magnet disposed at said housing and a second magnet disposed at said exchangeable receiver.

3. The hearing instrument according to claim 1, wherein said coupler includes a protrusion disposed at a surface of said exchangeable receiver and an interlocking structure configured to be coupled to a surface of said housing adapted to lock-in said protrusion while actuating said physical coupling and to lock-out said protrusion while de-actuating said physical coupling.

4. The hearing instrument according to claim 3, wherein said interlocking structure is an assembly of a pinhole in said surface of said housing and a locking pin configured to be locked-in said pinhole for actuating and to be locked-out of said pinhole for de-actuating said physical coupling between said exchangeable receiver and said housing.

5. The hearing instrument according to claim 3, wherein said protrusion is formed of a compressible material allowing said protrusion to be compressed to slide into said housing while actuating or slide out of said housing while de-actuating said physical coupling.

6. The hearing instrument according to claim 1, wherein:

said opening in said housing includes a remaining portion left after placing said exchangeable receiver into said opening; and a sealing is configured to be placed into said opening in said housing between said exchangeable receiver and said housing for sealing said remaining portion of said opening.

7. The hearing instrument according to claim 6, wherein said sealing includes a part facing said housing, said part having a wedge-shaped geometry.

8. The hearing instrument according to claim 1, which further comprises a receiver cup configured to receive said exchangeable receiver and to physically couple said exchangeable receiver to said housing.

9. The hearing instrument according to claim 1, wherein said housing is non-customized and has an outer surface, said customized shell has an outer surface, and said outer surfaces of said non-customized housing and said customized shell form said smooth transition between said non-customized housing and said customized shell.

10. The hearing instrument according to claim 1, wherein said housing is non-customized, and said non-customized housing and said customized shell are detachably interconnected.

11. A method for making a hearing instrument, the method comprising the following steps:

forming an opening in a housing;

placing an exchangeable receiver in and holding the receiver in the opening in the housing; and smoothly attaching a customized shell made according to a user's ear to the housing and forming a smooth transition between the customized shell and the housing; and actuating and de-actuating a coupler providing a physical coupling between the housing and the exchangeable receiver and enabling the housing to hold the exchangeable receiver.

12. The method according to claim 11, which further comprises providing the coupler as a magnetic configuration by affixing a first magnet of the magnetic configuration at the housing and affixing a second magnet of the magnetic configuration at the exchangeable receiver.

13. The method according to claim 11, which further comprises:

providing the coupler with a protrusion at a surface of the exchangeable receiver and an interlocking structure to be coupled to a surface of the housing; and locking-in the protrusion with the interlocking structure while actuating the physical coupling and locking-out the protrusion with the interlocking structure while de-actuating the physical coupling.

14. The method according to claim 13, which further comprises:

providing the interlocking structure with a pinhole in a surface of the housing and a locking pin configured:

to be locked-in the pinhole for actuating the physical coupling between the exchangeable receiver and the housing, and to be locked-out of the pinhole for de-actuating the physical coupling between the exchangeable receiver and the housing.

15. The method according to claim 11, which further comprises:

providing the opening with a remaining portion left after placing the exchangeable receiver into the opening; and placing a sealing into the opening of the housing between the exchangeable receiver and the housing, sealing the remaining portion of the opening.

16. The method according to claim 11, which further comprises placing the receiver into a receiver cup, and physically coupling the exchangeable receiver to the housing using the receiver cup.

* * * * *